US009133646B1

(12) United States Patent
Jennings

(10) Patent No.: US 9,133,646 B1
(45) Date of Patent: Sep. 15, 2015

(54) LOCK DECODERS

(71) Applicant: UAP Limited, Manchester (GB)

(72) Inventor: David Jennings, Manchester (GB)

(73) Assignee: UAP LIMITED, Manchester (GB)

( * ) Notice: Subject to any disclaimer, the term of this patent is extended or adjusted under 35 U.S.C. 154(b) by 0 days.

(21) Appl. No.: 14/662,942

(22) Filed: Mar. 19, 2015

(30) Foreign Application Priority Data

Mar. 31, 2014 (GB) ..... 1405701.2

(51) Int. Cl.
*E05B 19/00* (2006.01)
*E05B 19/20* (2006.01)

(52) U.S. Cl.
CPC ..... *E05B 19/0011* (2013.01); *E05B 19/20* (2013.01); *Y10T 70/7797* (2015.04)

(58) Field of Classification Search
CPC . Y10T 70/7797; Y10T 70/7864; E05B 19/20; E05B 19/205
USPC ..... 70/394–399; 33/539, 540; 81/15.9
See application file for complete search history.

(56) References Cited

U.S. PATENT DOCUMENTS 1,991,151 A * 2/1935 Hansen ..... 33/540
2,066,645 A * 1/1937 Rial ..... 33/540
2,070,228 A * 2/1937 Fitz Gerald ..... 33/539
2,338,768 A * 1/1944 Johnstone ..... 33/540
2,382,806 A * 8/1945 Motson ..... 430/292
2,485,051 A * 10/1949 Joslin ..... 70/456 R
2,510,998 A * 6/1950 O'Brien ..... 356/391
2,707,335 A * 5/1955 Falk ..... 33/539
2,720,032 A * 10/1955 Harwell ..... 33/540
2,778,903 A * 1/1957 Hopkins, Jr. ..... 250/466.1
2,791,840 A * 5/1957 Harwell ..... 33/540
3,087,050 A * 4/1963 Rubens ..... 362/119
3,106,880 A * 10/1963 Rossetto et al. ..... 396/551
3,500,326 A * 3/1970 Benford ..... 235/444
3,735,496 A * 5/1973 Lee ..... 33/540
3,797,936 A * 3/1974 Dimitriadis ..... 356/71
3,827,151 A * 8/1974 Naill ..... 33/540
4,012,991 A * 3/1977 Uyeda ..... 409/81
4,177,657 A * 12/1979 Aydin ..... 70/278.2
4,185,482 A * 1/1980 Nail ..... 70/394
4,680,870 A * 7/1987 McConnell ..... 33/540
6,134,928 A * 10/2000 Kang ..... 70/394
6,415,523 B1 * 7/2002 Wood ..... 33/539
7,895,763 B2 * 3/2011 Capehart ..... 33/540
2005/0092048 A1 * 5/2005 Mathena ..... 70/394
2011/0067254 A1 * 3/2011 Randall ..... 33/540

* cited by examiner

*Primary Examiner* — Suzanne Barrett
(74) *Attorney, Agent, or Firm* — Egbert Law Offices, PLLC

(57) ABSTRACT

A lock decoder with a light source has a plate and at least one pick lever that is adapted at one end for insertion in a lock to be decoded and adapted at its other end by provision of a pointer. The pointer moves over the plate as the pick lever is manipulated within a lock and this side of the plate bears indications comprising a range of key bitting codes for each pin position within the lock that may be individually indicated by the pointer. The plate is adapted to permit light to shine through at least predetermined parts of it to illuminate the indications and the light source is secured to the decoder so that it shines through the plate. Preferably, the light source comprises a fluorescent or phosphorescent backing-plate that is secured over the other side of the plate.

11 Claims, 4 Drawing Sheets

LOCK DECODERS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to lock decoders and in particular but not exclusively to vehicle lock decoders.

2. Description of Related Art Including Information Disclosed Under 37 CFR 1.97 and 37 CFR 1.98

Lock decoders are used by locksmiths to decode a lock so that a key can be cut to gain entry, typically to a vehicle where the correct key has been lost or is not available, for example if the vehicle has been abandoned or stolen. The decoder typically also enables such a lock to be picked. In use as a decoder the tool indicates by way of a grid and pointer the bitting of each of the pins and wafers of the lock so that a key can subsequently be cut. The user of the tool has to read off the bitting for each pin and wafer as the tool is in use and either remember it or jot it down. In practice, a locksmith often has to work in difficult conditions, for example in bad weather, at night and in dark locations. This makes reading a conventional lock decoding tool difficult. Shining a torch or other light on the decoder does not always assist because the decoder is generally made of metal and reflections from various parts of the decoder make reading the bitting codes from the grid difficult. Also, use of a decoder requires two hands so that using a torch or light successfully in addition is not always possible for one man.

The object of the present invention is to provide a lock decoder that obviates or substantially mitigates the aforementioned problem.

BRIEF SUMMARY OF THE INVENTION

According to the present invention there is provided a lock decoder with a light source secured thereto, the lock decoder comprising:

at least one pick lever adapted at one end for insertion into a lock to be decoded and adapted at its other end by provision of a pointer, and a plate over one side of which the pointer moves as the pick lever is manipulated within a lock, one side of the plate bearing indications comprising a range of key bitting codes for each pin position within the lock that may be individually indicated by the pointer, and the plate being adapted to permit light from said light source to shine through at least predetermined parts thereof to illuminate the indications.

Preferably, the light source comprises a fluorescent or phosphorescent backing-plate that is secured over the other side of the plate.

Preferably also, the indications comprise a series of first holes through the plate through which the light source shines.

Preferably also, the indications include numbers that are delineated by second holes formed in the plate.

Other preferred but non-essential features of the present invention are described in the dependent claims appended hereto.

BRIEF DESCRIPTION OF THE SEVERAL VIEWS OF THE DRAWINGS

An embodiment of the present invention will now be described by way of example with reference to the accompanying drawings, in which:—

DETAILED DESCRIPTION OF THE INVENTION

Figure 1:
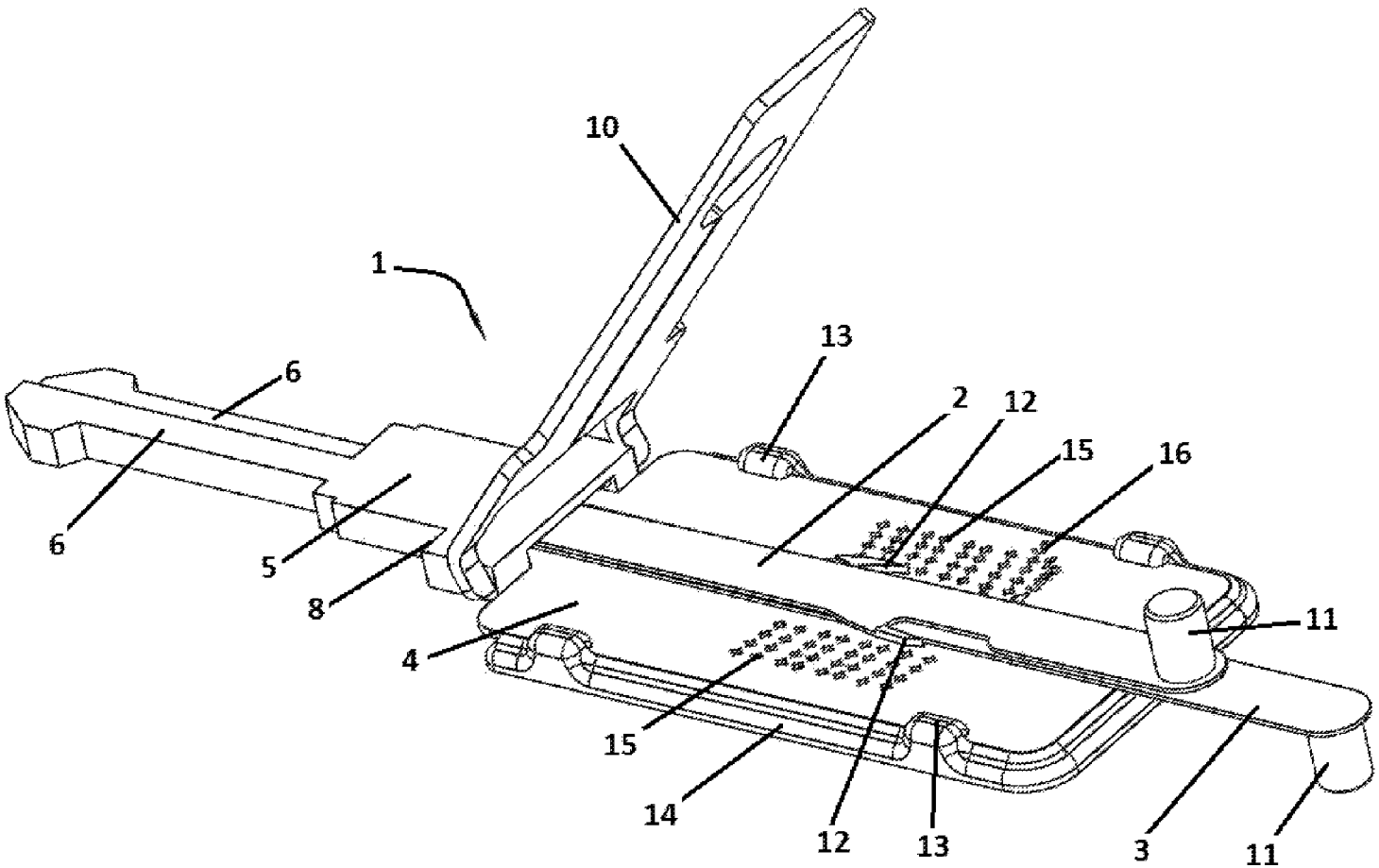
FIG. 1 is a perspective view from one side and end of a lock decoder in accordance with the present invention.
Figure 2:
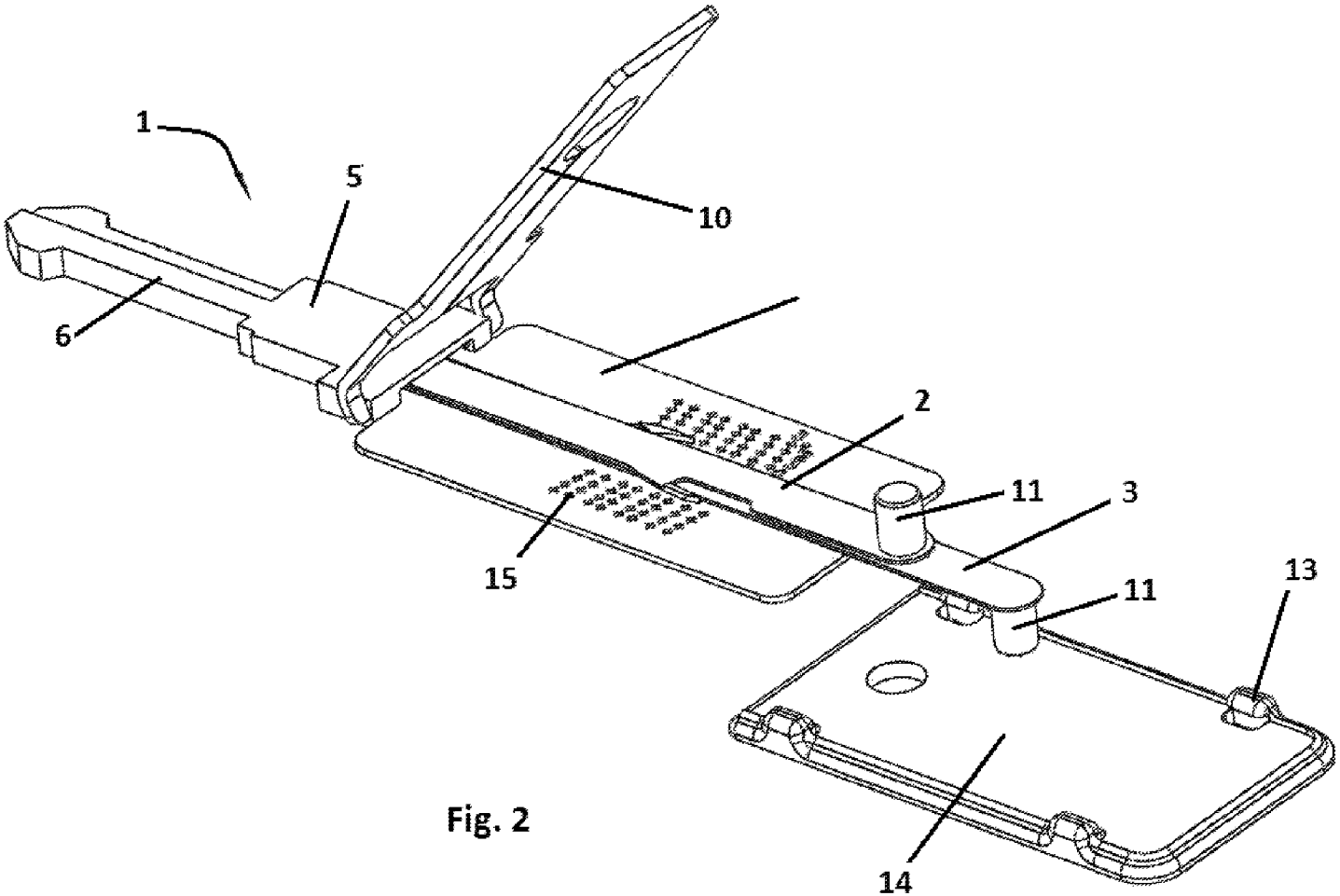
FIG. 2 is a view similar to FIG. 1 but with a backing plate for the decoder shown detached therefrom.
Figure 3:
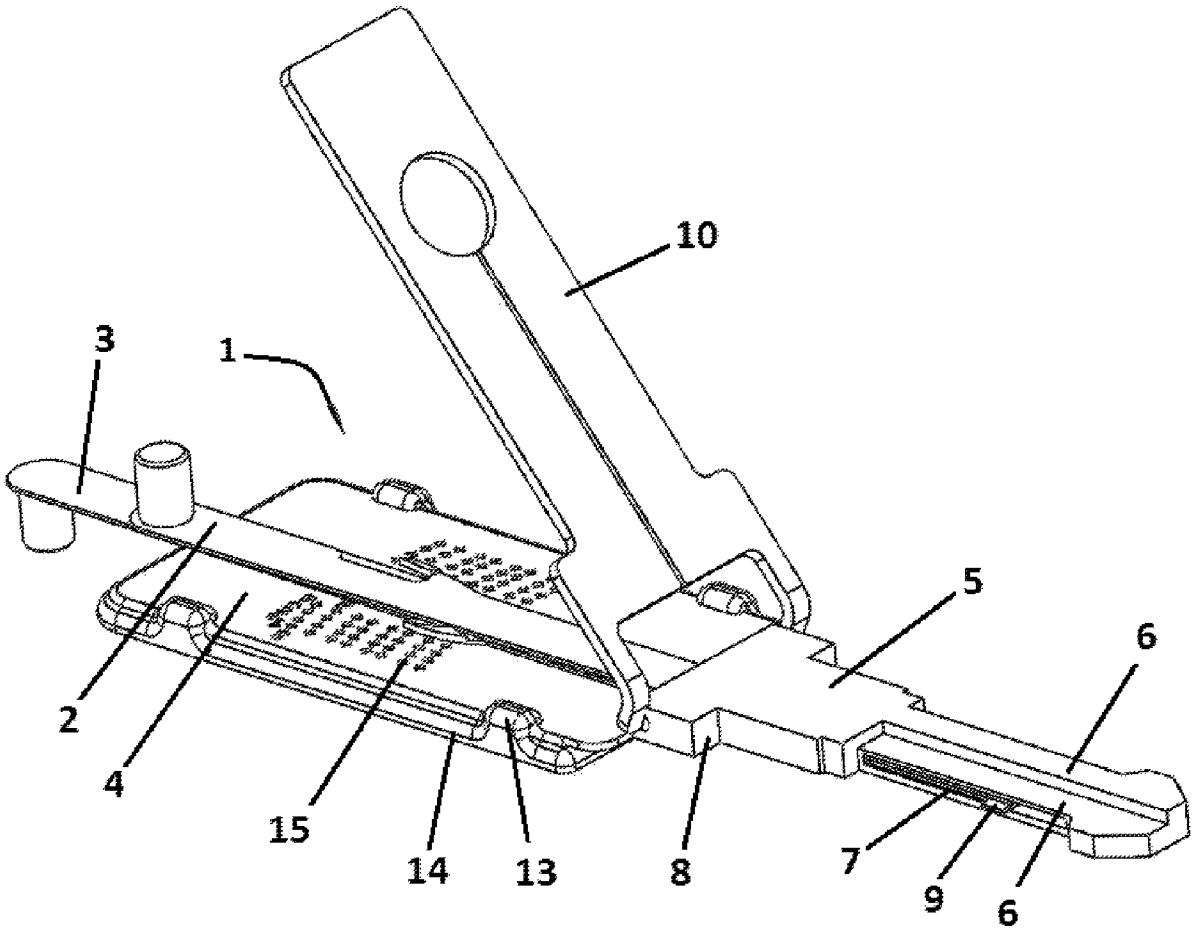
FIG. 3 is a view similar to FIG. 1 but from the other side and end of the decoder.

A lock decoder 1 is shown in the drawings and comprises a pair of pick levers 2, 3 that are secured to a plate 4 intermediate each of their ends. The plate 4 is substantially rectangular but has a projecting portion covered by a sleeve 5 and the levers 2, 3 are secured by the sleeve 5 to this projecting portion such that they can move longitudinally with respect to the plate 4 and also rotate relative to it, the width of the sleeve 5 limiting the extent to which they may rotate. Conjoined to the sleeve 5 on its side opposite the plate 4 is a pair of projecting sheaths 6 in which one end 7 of each of the pick levers 2, 3 can move longitudinally in and out of the sleeve 5 (see FIG. 3). The sheaths 6 effectively form a dummy key that is inserted into the lock to be decoded up to a shoulder 8 defined by the sleeve 5. The ends 7 of each pick lever 2, 3 are each provided with an outwardly turned feeler 9 so that the picks lever 2, can detect the location of wafers and pins within the lock. The feelers 9 project on the opposite sides of the sheaths 6 so that one pick lever 2, 3 can detect the pins at the top of a lock and the other lever 3, 2 can detect the pins at the bottom of the lock. In a variation, the lock decoder 1 may have only one pick lever, the end of which is provided with two outwardly turned feelers.

A tensioning bar 10 is rotatably secured to the sleeve 8. The bar 10 is adapted to overlie the plate 4 when the decoder 1 is not in use but is rotatable away from the plate 4 to a position where it is substantially normal to the plate 4 when the decoder 1 is in use. The bar is used to apply torque to the rotatable core of plug of the lock when the decoder 1 is in use.

The other ends of the pick levers 2, 3 lie above the plate 4 and project slightly beyond it. These ends are each provided with a handle 11 to assist in manipulation of the levers 2, 3. Each of the pick levers 2, 3 is also provided with a pointer 12 that is used in conjunction with a series of indications formed on the plate 4, as described below.

Attached to the back of the plate 4 by a series of clips 13 is a backing plate 14. Preferably, the backing plate 14 is removably secured to the plate 4 by the clips 13 so that it can be put in position when required but otherwise removed therefrom. In the illustrated embodiment the backing plate 14 slides over the back of the plate 4 and partially frames it. The backing plate 14 is made from a fluorescent or phosphorescent plastic.

In a conventional lock decoder markings in the form of a series of numbered lines that form a grid are formed on the plate 4. The lines represent the bitting codes for keys that are capable of unlocking a lock of the type to be decoded. Hence, the decoder and the markings are specially adapted for the make and type of lock in question, which is typically vehicle model specific. In use, as each pick lever 2, 3 detects one of the wafers and pins within the lock its pointer 12 points to one of the intersections of the grid which represents the wafer position and bitting code for the pin of that wafer. In this way a series of bitting codes can be detected for the lock so that an appropriate key can be cut for it.

Figure 4:
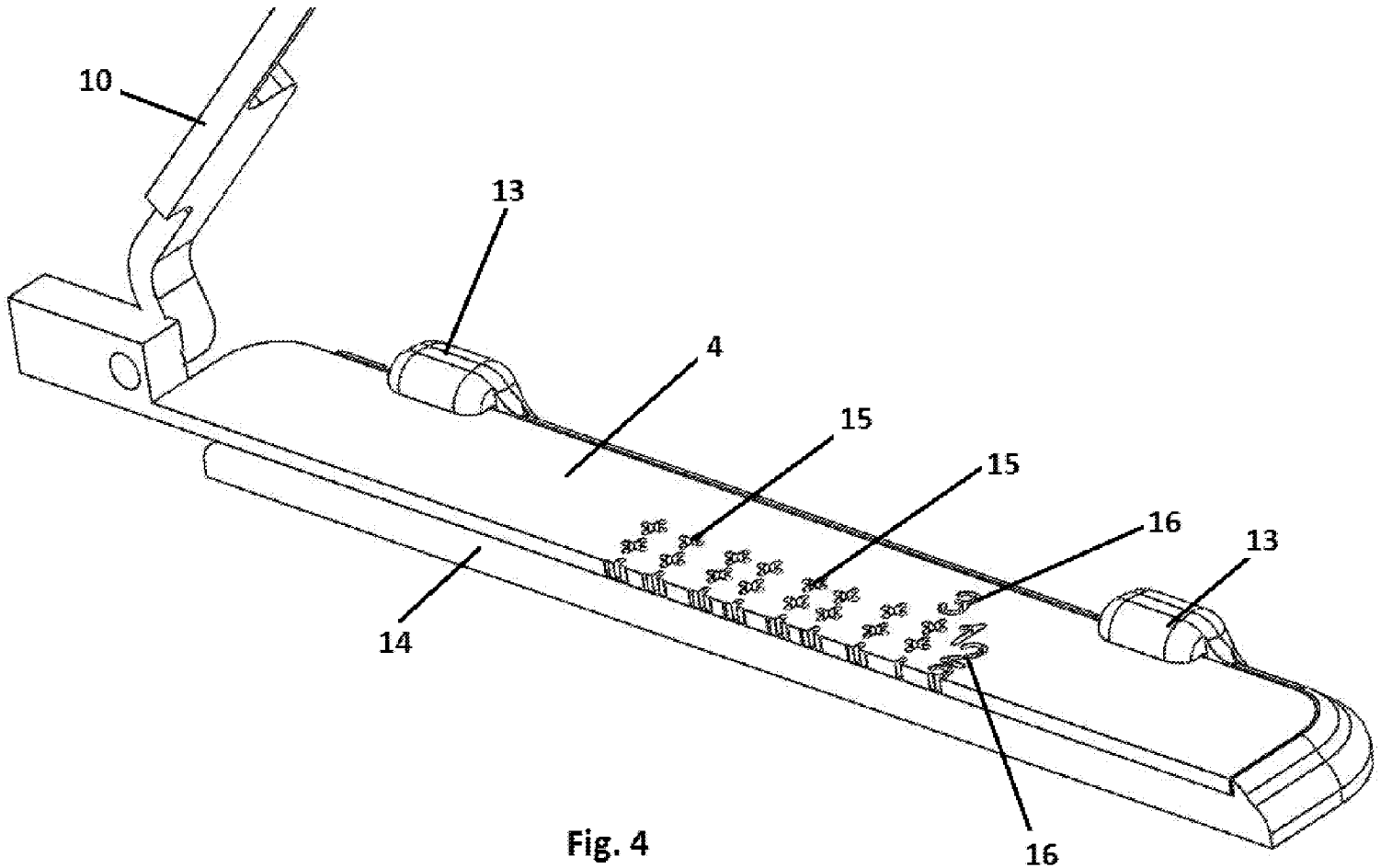
FIG. 4 is a perspective view of a longitudinal section through part of the decoder shown in FIG. 1 but to an enlarged scale.

In the present invention as shown in particular in FIG. 4 of the drawings, the markings on the plate 4 are replaced by indications in the form of a series of holes 15 through the plate 4 that are located at what would have been intersections between the lines of the grid. Preferably, therefore, the holes 15 form a series of rows and columns. In the illustrated embodiment the holes 15 are each in the form of a cross but in other embodiments they may be simply circular, pin-prick holes. It will be appreciated that the backing plate 14 can be seen through the holes 15 and in appropriate low light conditions it will illuminate them. The numbers for the rows and columns are delineated by additional holes 16 formed in the plate 4 so that these also can be readily seen. The tips of the pointers 12 are also preferably covered by painting or printing with fluorescent or phosphorescent paint or ink markings. Hence, in use in either darkness or low light conditions the grid markings and numbers on the plate 4 can be readily seen and read.

In an alternative arrangement, which is not illustrated, the plate 4 is made in the form of a sleeve with a front face with the markings comprising holes 15 as described above and a plain back face. The fluorescent or phosphorescent backing plate 14 is then adapted to slide into the sleeve behind the front face whilst being protected by the back face. As with the illustrated example, the backing plate 14 can be inserted into the sleeve for use when required.

In another alternative arrangement, the plate 4 is made of a translucent material on which markings are printed. In this case the light emitted by the backing plate 14 shines through the plate 4 to illuminate it in poor light conditions. As, however, such a plate 4 is usually made of plastics material, it is generally not as robust as a plate 4 made of metal, which will usually be the case with decoders made as shown in FIGS. 1 to 4.

The lock decoder 1 in accordance with the invention is intended to be operated in a conventional way, which will not be described further here. However, it will be appreciated that the adaptions described above facilitate its use in bad weather, at night and in dark locations.

I claim:

1. A lock decoder comprising:

at least one pick lever having one end adapted at one end for insertion into a lock to be decoded and another end adapted by provision of a pointer;

a plate over a first side of which the pointer moves as the pick lever is manipulated within a lock, said first side of said plate bearing indications comprising a range of key bitting codes for each pin position within the lock that are individually indicated by the pointer, the indications comprising a series of first holes through said plate; and a light source positioned so as to shine through said series of first holes in said plate.

2. The lock decoder of claim 1, wherein the light source comprises a fluorescent or phosphorescent backing-plate that is secured over a second side of the plate.

3. The lock decoder of claim 2, wherein the backing-plate is provided with clips whereby said backing-plate is removably securable to the plate.

4. The lock decoder of claim 1, wherein said series of first holes form a series of rows and columns.

5. The lock decoder of claim 1, wherein said series of first holes define a shape of a cross.

6. The lock decoder of claim 1, wherein the indications include numbers that are delineated by a series of second holes formed in the plate.

7. The lock decoder of claim 6, wherein the series of first holes form a series of rows and columns and the numbers are labels for the series of rows and columns.

8. The lock decoder of claim 1, wherein a tip of the pointer is covered with a fluorescent paint.

9. The lock decoder of claim 1, wherein the plate is comprised of a translucent material on which the indications are printed.

10. The lock decoder of claim 1, wherein a tip of the pointer is covered with a phosphorescent paint.

11. The lock decoder of claim 1, wherein a tip of the pointer is covered with ink markings.

* * * * *